United States Patent [19]

Rossum

[11] Patent Number: 5,072,645

[45] Date of Patent: Dec. 17, 1991

[54] OUTPUT STAGE FOR A MULTITIMBRAL ELECTRONIC MUSICAL INSTRUMENT PROVIDING AUTOMATIC DETECTION OF THE USE OF SUBMIX OUTPUTS

[75] Inventor: David P. Rossum, Santa Cruz, Calif.

[73] Assignee: E-mu Systems, Inc., Scotts Valley, Calif.

[21] Appl. No.: 462,690

[22] Filed: Jan. 11, 1990

[51] Int. Cl.[5] ..... G10H 5/00; G10H 1/08

[52] U.S. Cl. ..... 84/660; 84/DIG. 27; 381/118; 381/123

[58] Field of Search ..... 84/600–608, 84/618, 625, 656, 660, 684, 697, DIG. 23, DIG. 27, 647, 644, 670, 718, 723, 743; 381/123, 118, 119

[56] References Cited

U.S. PATENT DOCUMENTS

| | | | |
|---|---|---|---|
| 4,041,825 | 8/1977 | Pascetta | 84/618 |
| 4,345,500 | 8/1982 | Alonso et al. | 84/647 |
| 4,468,806 | 8/1984 | Gaulden et al. | 381/123 |
| 4,509,190 | 4/1985 | Spector | 381/123 X |
| 4,539,883 | 9/1985 | Chihana | 84/625 |
| 4,682,526 | 7/1987 | Hall et al. | 84/618 |

OTHER PUBLICATIONS

Allied Radio catalog, "Allied Electronics for Everyone", 1967, pp. 324–325.

*Primary Examiner*—Stanley J. Witkowski
*Assistant Examiner*—Jeffrey W. Donels
*Attorney, Agent, or Firm*—Stephen E. Baldwin

[57] ABSTRACT

An output stage for a multitimbral electronic musical instrument providing automatic detection of the use of submix outputs is provided. The present invention allows the use of effects processors on selected timbres without the need for user intervention when the effects are connected or removed. The present invention also allows for use of such processors without an external mixboard.

6 Claims, 6 Drawing Sheets

OUTPUT STAGE FOR A MULTITIMBRAL ELECTRONIC MUSICAL INSTRUMENT PROVIDING AUTOMATIC DETECTION OF THE USE OF SUBMIX OUTPUTS

BACKGROUND OF THE INVENTION

The present invention relates to electronic musical instruments and more particularly to an output stage for a multitimbral electronic musical instrument providing automatic detection of the use of submix outputs.

Electronic musical instruments typically have a single audio output, either monophonic or stereophonic. When used for recording, these instruments are connected into a mixboard, which then routes the audio from certain instruments through effects processors such as reverberators or equalizers, and then produces a single final mono or stereo mixdown of the several instruments used in a musical performance, each appropriately processed.

Modern electronic musical instruments have the ability to play several instruments or timbres at once, that is they are multitimbral. While it is obvious that the differing timbres can be routed to one of several mono or stereo outputs for further routing through the mixboard, several problems arise from this approach. First, a given user may wish to use the instrument with or without a mixboard, and hence may or may not desire the multiple outputs to be functional. Secondly, a user may wish to use some effects processing, but wish to avoid the expense and complexity of a mixboard.

SUMMARY OF THE INVENTION

It is an object of the present invention to provide an improved multitimbral musical instrument.

It is a more particular object of the current invention to allow a multitimbral musical instrument to be used with or without a mixboard and/or effects processors, without the need for user controls or changes in user programming.

The present invention is directed toward an output stage for a multitimbral musical instrument with monophonic or stereophonic main and submix outputs. The output stage includes routing means for sending each musical note to one of the outputs, detection means for detecting if a submix output is being utilized, and logic means that causes the routing means to send musical notes intended for the auxiliary output to the main output if the auxiliary output is not being utilized.

Additional objects, advantages and novel features of the present invention will be set forth in part in the description which follows and in part become apparent to those skilled in the art upon examination of the following or may be learned by practice of the invention. The objects and advantages of the present invention may be realized and attained by means of the instrumentalities and combinations which are pointed out in the appended claims.

BRIEF DESCRIPTION OF THE DRAWINGS

The accompanying drawings which are incorporated in and form a part of this specification illustrate an embodiment of the invention and, together with the description, serve to explain the principles of the invention.

DESCRIPTION OF THE PREFERRED EMBODIMENT

Reference will now be made in detail to the preferred embodiment of the invention, an example of which is illustrated in the accompanying drawings. While the invention will be described in conjunction with the preferred embodiment, it will be understood that it is not intended to limit the invention to that embodiment. On the contrary, it is intended to cover alternatives, modifications and equivalents as may be included within the spirit and scope of the invention as defined by the appended claims.

Figure 1:
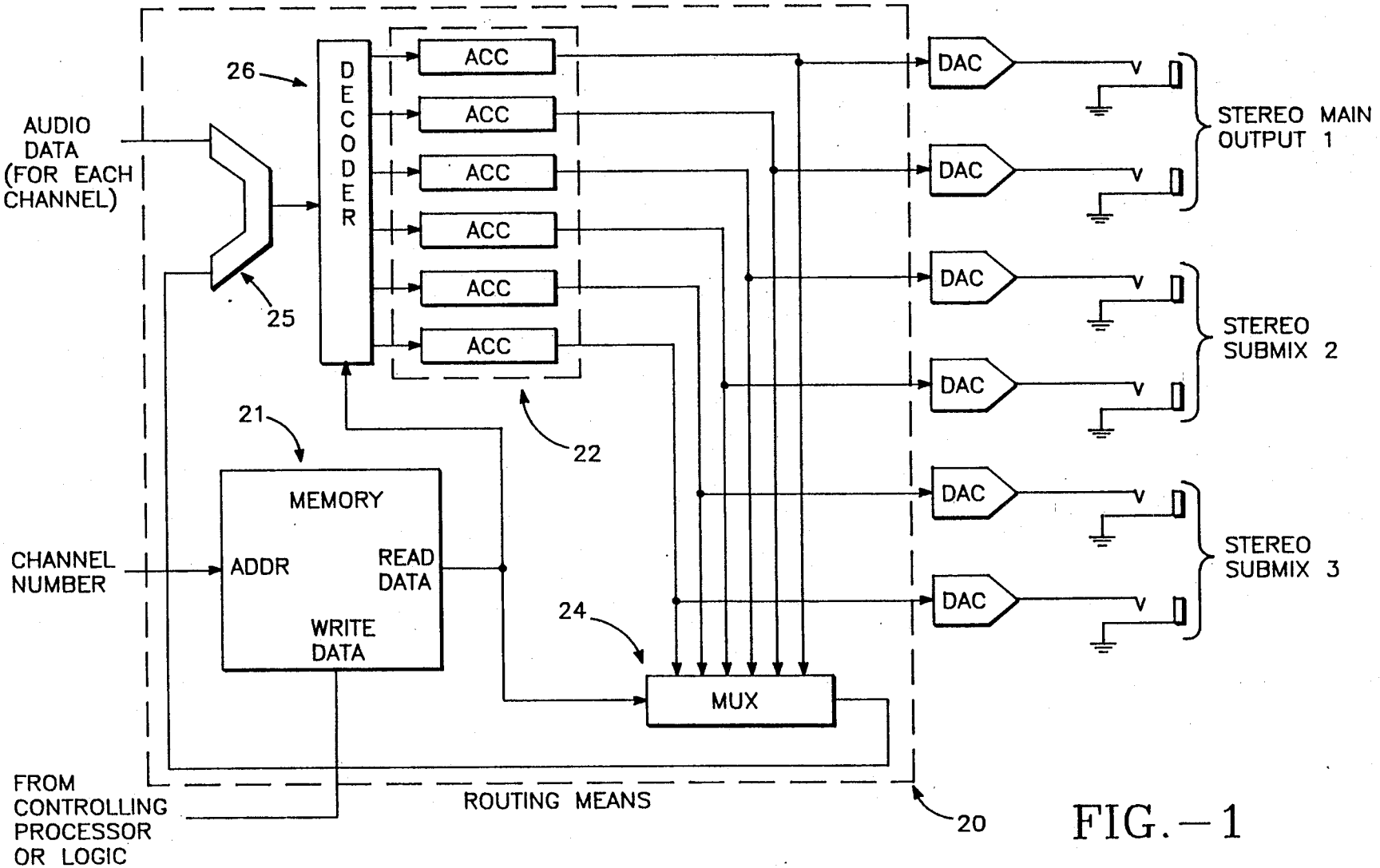
FIG. 1 shows the output stage of a typical multitimbral instrument with submix outputs.

FIG. 1 shows the output structure of a typical multitimbral musical instrument. Note the main stereo output pair 1 and the stereo submix output pairs 2 and 3.

Routing means 20 operates in the following manner. Each musical note is associated with a channel. Memory 21 is addressed by the channel number of each note, and contains a number representing the output (main or submix) to which that note is to be sent. Accumulator bank 22 contains an accumulator for each output, main or submix. Multiplexer 24 addresses accumulator bank 22 to obtain the previously accumulated channels for the output associated with this channel according to the contents of memory 21. Adder 25 then adds the audio data for the current note to the multiplexer output, which data is then saved in the associated accumulator by decoder 26. The accumulators are initialized to zero and are routed to the digital to analog converters by conventional digital logic well known to those skilled in the art.

Figure 2:
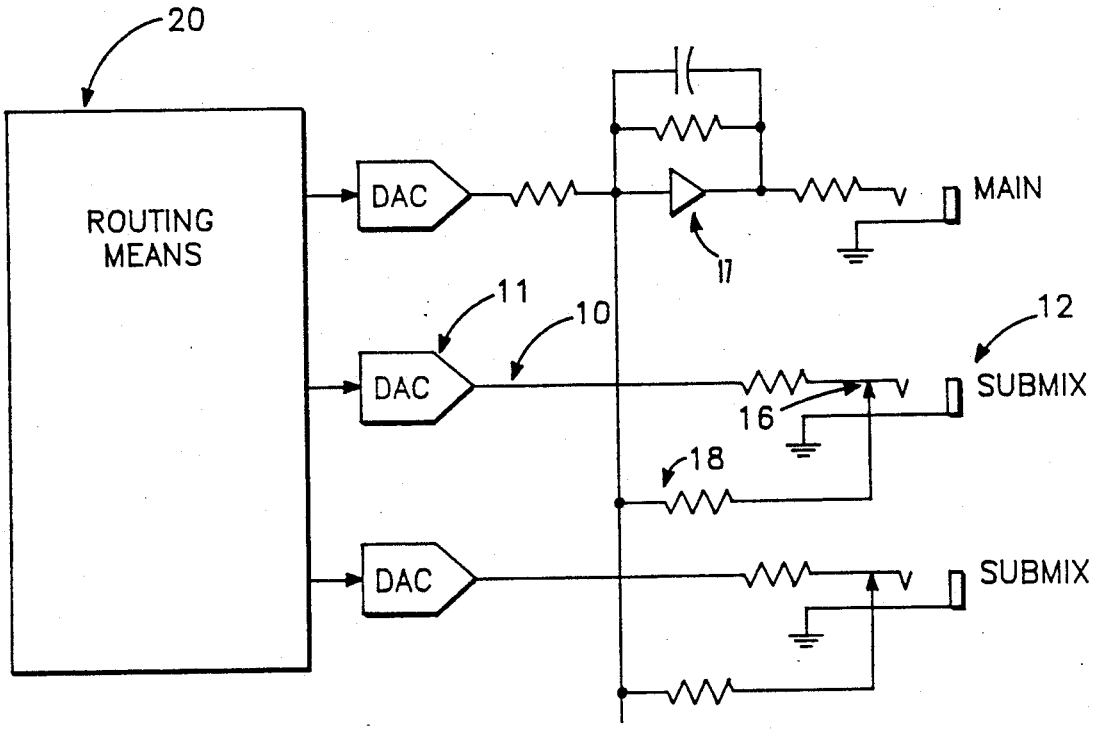
FIG. 2 shows an analog implementation of the current invention.
Figure 3:
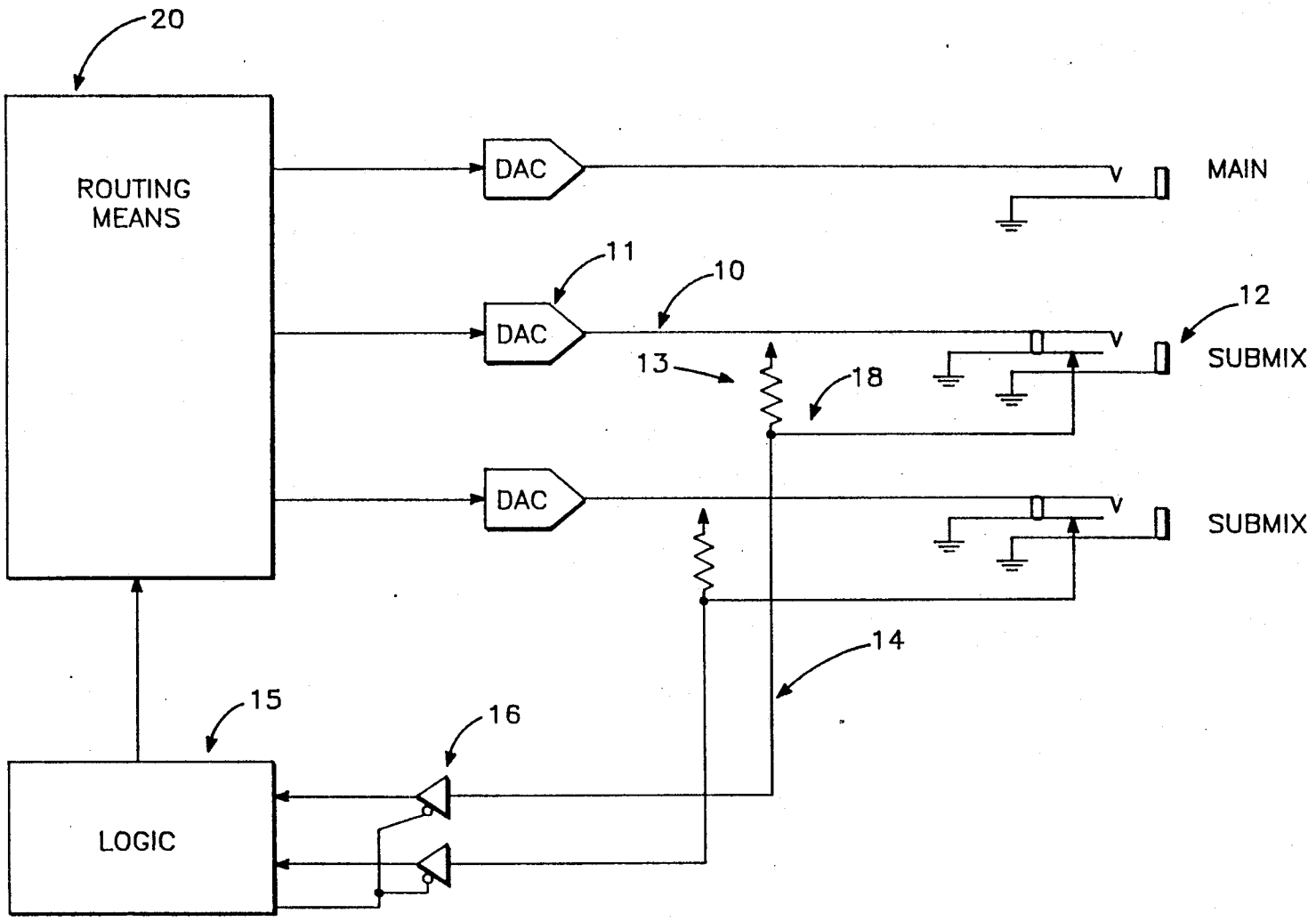
FIG. 3 shows a digital implementation of the current invention.
Figure 4:
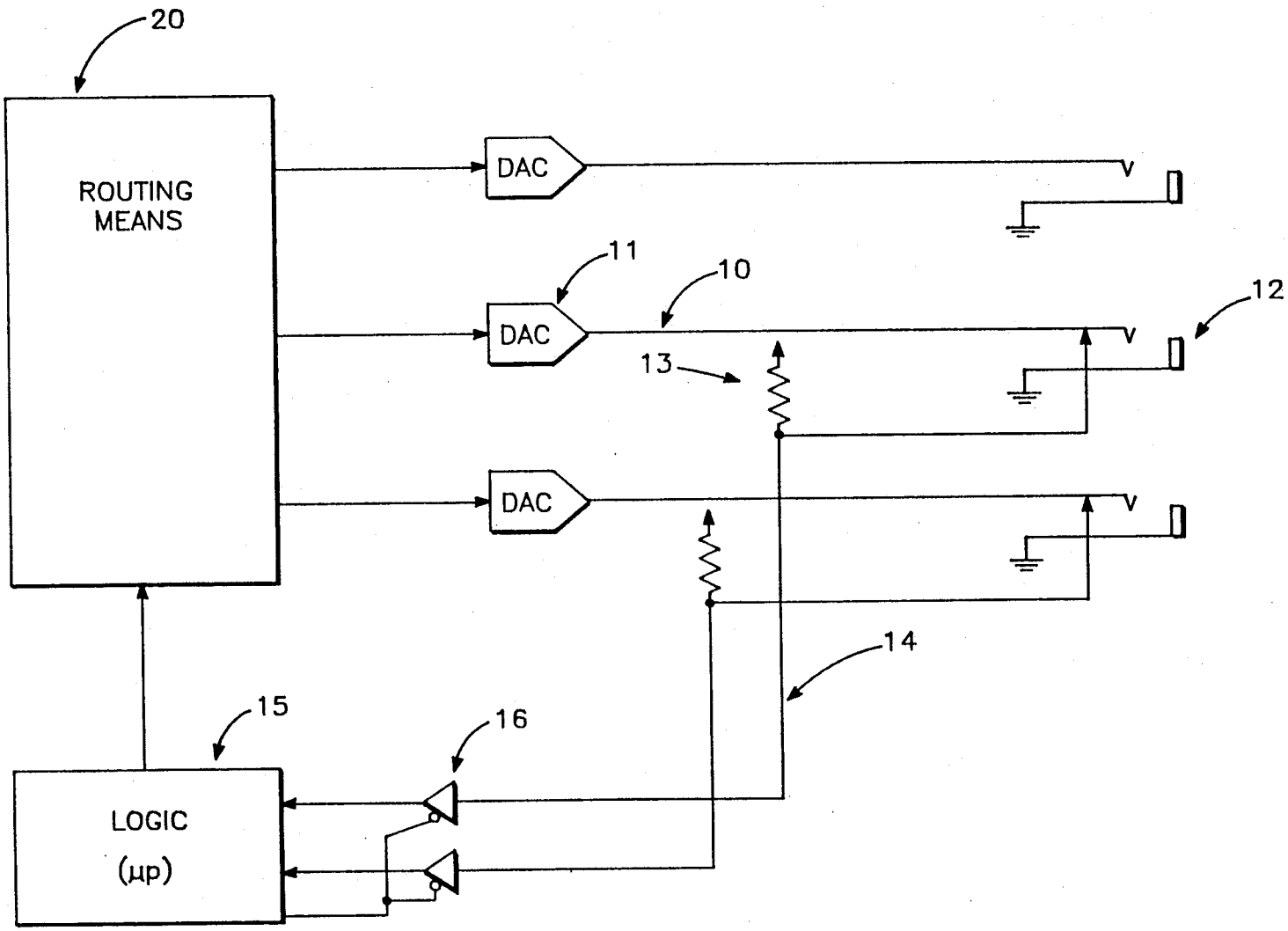
FIG. 4 shows the preferred digital implementation of the current invention.

To meet the objective of requiring no user intervention when a mixboard and effects processor is used, the instrument includes an automatic method of detection to determine when one or more of the submix outputs is in use, so that signals are not sent to unused outputs. In one embodiment, this could be done by using a normalled signal as shown in FIG. 2, or a switched jack as shown in FIG. 3. The preferred embodiment is shown in FIG. 4. Notice that in the preferred embodiment the number of connections is minimized, and that the signal routing is all done digitally, eliminating the possibility of analog distortion and noise.

The operation of FIG. 2 will now be described. When a connector is plugged into output jack 12, the analog output 10 from digital-to-analog converter 11 is switched out of the mix output opamp 17 by normalling switch 16. When the connector is removed, normalling switch 16 routes the analog signal into the mix output opamp 17 through resistor 18.

The operation of FIGS. 3 and 4 is as follows. In FIG. 3, analog output 10 from digital-to-analog converter 11 represents the output of a submix. When a connector is placed in associated output jack 12, resistor 13 pulls sense line 14 high. Line 14 can be read by logic means 15 (which is typically a microprocessor) through tri-state buffer 16, allowing detection of the presence of a connector in the output jack. When a connection is detected, logic means 15 allows the routing of a signal to the associated submix output if the programming by the user has requested it, by storing the associated submix output in the channel's memory in routing means 20. Up to this point, the configurations in FIGS. 3 and 4 work in an identical manner. When a connector is absent from output jack 12, the switched jack configuration of FIG. 3 obviously presents a low logic level to sense line 14, completing the detection.

The operation of the preferred embodiment of FIG. 4 will now be described. In this case, it is output line 10 that is connected to the sense line. It can be seen upon consideration that when the user ceases playing music, output line 10 will be quiescent at zero volts, and the sense line 14 will be at a low logic level. When the user completes changing his connections and begins to play music through the instrument, the microprocessor will be able to detect the absence of a connection to the output jack and will not route any signals to output 10. Hence output 10 will be maintained in the quiescent zero voltage state, and will continue to be correctly detected as having no connection until a connection is inserted into the jack.

Figure 5:
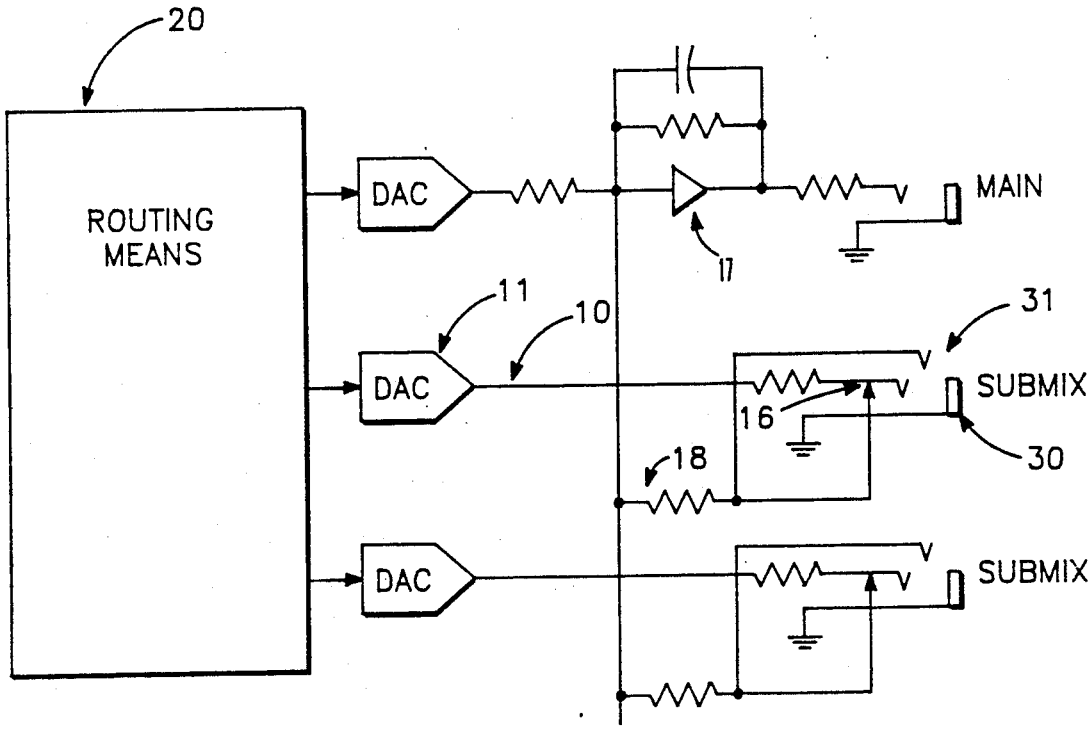
FIGS. 5, 6, and 7 show the same analog, digital, and preferred implementations of the current invention with an improvement.
Figure 6:
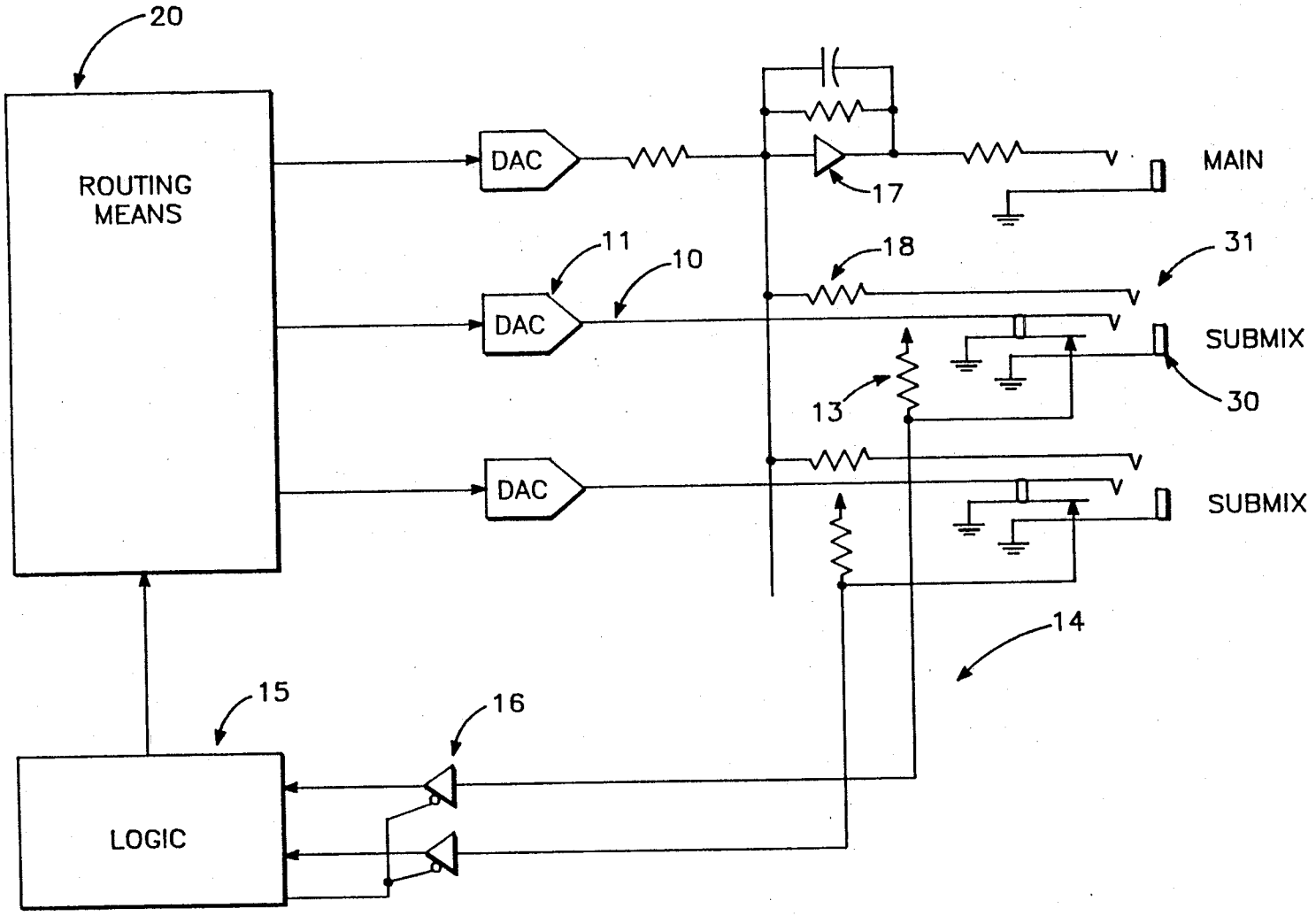
Figure 7:
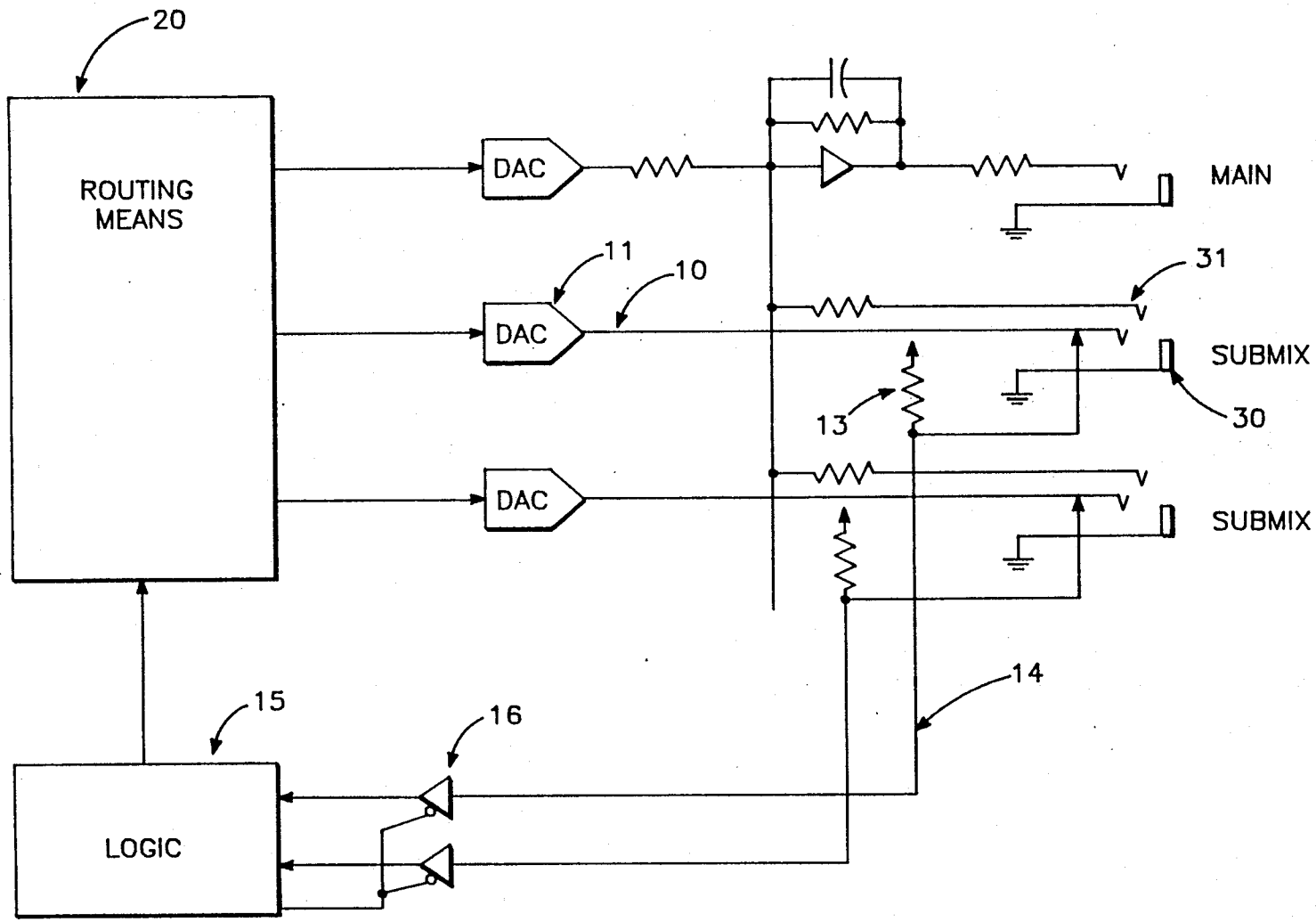

FIGS. 5, 6, and 7 show a further improvements to the corresponding embodiments of FIGS. 2, 3, and 4 respectively. In this case, the "ring" input 31 of a stereo jack 30 is used as an input to the output opamp 17 in the instrument. This aspect eliminates the requirement of an external mixboard when external effects processing is done on an auxilliary output. This is done at the cost of a single jack connection element and a single resistor 18 per auxilliary output, plus the cost of the output opamp and ancillary components.

The foregoing description of the preferred embodiment of the invention has been presented for purposes of illustration and description. It is not intended to be exhaustive or to limit the invention to the precise form disclosed, and many modifications and variations are possible in light of the above teaching. The preferred embodiment was chosen and described in order to best explain the principles of the invention and its practical applications to thereby enable others skilled in the art to best utilize the invention and various embodiments and with various modifications as are suited to the particular use contemplated. It is intended that the scope of the invention be defined only by the claims appended hereto.

What is claimed is:

1. An output stage for a multitimbral musical instrument with monophonic stereophonic main and submix auxiliary outputs of musical notes comprising:

routing means for sending each musical note to one of said outputs, detection means for detecting if a submix output is being utilized, and logic means that automatically causes said routing means to digitally send musical notes intended for the auxiliary output to said main output if said auxiliary output is not being utilized.

2. The output stage of claim 1 wherein said detection means is a switch within a connection jack associated with said submix output.

3. The output stage of claim 2 wherein said switch is a single pole single throw element connected to the output signal when the submix is not utilized, and wherein said element is not connected when the output is utilized.

4. The output stage of claim 3 wherein an additional signal input is provided in said connection jack which is summed with the main output signal.

5. An output stage as in claim 3 wherein said output includes an output line and wherein said detection means includes a sense line electrically connected to said output line when said submix is not utilized and said output line is quiescient at zero volts and said sense line is at a different voltage logic level when said output is being utilized.

6. The output stage as in claim 5 wherein said logic means include means for detecting the absence of a connection to said output jack so as to not route any signals to said outputs.

* * * * *